US006523527B1

(12) United States Patent
Ozaki et al.

(10) Patent No.: US 6,523,527 B1
(45) Date of Patent: Feb. 25, 2003

(54) CANISTER STRUCTURE INSTALLED IN AN AUTOMOBILE

(75) Inventors: Katsunori Ozaki, Kanagawa-ken (JP); Tomiyuki Satoh, Kanagawa-ken (JP); Michiaki Sasaki, Kanagawa-ken (JP); Osamu Igarashi, Kanagawa-ken (JP); Akira Tabuchi, Tokushima-ken (JP); Kiyozumi Tani, Tokushima-ken (JP); Atsushi Kamada, Tokushima-ken (JP); Masaharu Kamei, Tokushima-ken (JP)

(73) Assignees: Nissan Motor Co., Ltd., Yokohama (JP); Kabushiki Kaisha NIX, Yokohama (JP); Otsuka Kagaku Kabushiki Kaisha, Osaka (JP); Earth Biochemical Co., Ltd., Tokushima-ken (JP)

( * ) Notice: Subject to any disclaimer, the term of this patent is extended or adjusted under 35 U.S.C. 154(b) by 35 days.

(21) Appl. No.: 09/652,138

(22) Filed: Aug. 31, 2000

(30) Foreign Application Priority Data

Aug. 31, 1999 (JP) ..... 11-245130

(51) Int. Cl.[7] ..... F02M 33/02

(52) U.S. Cl. ..... 123/519

(58) Field of Search ..... 123/516, 517, 123/518, 519, 520, 521

(56) References Cited

FOREIGN PATENT DOCUMENTS

JP 9-228904 9/1997

*Primary Examiner*—Noah P. Kamen
(74) *Attorney, Agent, or Firm*—McDermott, Will & Emery

(57) ABSTRACT

A tubular resin contains small animal repelling chemical. And canister structure installed in an automobile comprises the above tubular resin on the inner wall of an air inlet port portion of a drain pipe. The canister structure absorbs evaporated fuel from a fuel tank by a absorbent in a main body of a canister and then supplies desorbed fuel from the adsorbent together with the air sucked from the drain pipe to an engine side. The tubular resin prevents entering of a small animal into the drain pipe and also building of its nest.

21 Claims, 4 Drawing Sheets

CANISTER STRUCTURE INSTALLED IN AN AUTOMOBILE

BACKGROUND OF THE INVENTION

1. Field of the Invention

The present invention relates to a vehicle canister structure and a chemical containing resin that can be installed in pipes of the canister structure.

2. Description of the Related Art

In canister structure in a prior art, fuel adsorbent such as active carbon is filled in inside of a main body of a canister. This main body of the canister is connected to a fuel tank and a suction pipe of an engine via a pipe respectively.

Evaporated fuel being generated in the fuel tank is adsorbed by the fuel adsorbent filled in the main body of the canister. In operating the engine, the adsorbed fuel is desorbed from the fuel adsorbent because of the negative pressure in the suction pipe of the engine, then supplied together with the air sucked via the drain pipe to the engine, and then burned in the engine.

Japanese Patent Application Publication H9-228904 published in 1997 discloses canister structure in which a separator for vapor-liquid separation is provided to the drain pipe.

SUMMARY OF THE INVENTION

If a volume of the main body of the canister is increased to improve the adsorption force of the evaporated fuel, a diameter of the drain pipe is also increased inevitably to some extent. Thus, the drain pipe has a structure into which the small animal enters easily. As such small animal, a chiracanthium has been known. Sometimes the chiracanthium enters into the drain pipe to lay eggs. If the chiracanthium builds its nest in the drain pipe, the pipe is blocked.

In order to.prevent the entering of such small animal, a mesh may be provided at the end of the air inlet port of the drain pipe. However, in that case, since an opening sectional area of the pipe is reduced, there are caused such problems that not only pressure loss in the pipe is increased but also there is a possibility that the mesh is blocked by the mud or the snow.

The overall drain pipe may be constructed by the resin material which is impregnated with the small animal repelling substance containing the repelling agent, the insecticide, etc. However, such drain pipe increases a cost and makes working operability worse. Workers must put on gloves not to directly touch the drain pipe in the assembling operation of the drain pipe. In addition, the worker must pay attention to the drain pipe not to touch the drain pipe in the operation in the neighborhood.

The present invention has been made in view of such problems, and it is an object of the present invention to prevent entering of a small animal into a drain pipe without making sacrifice of working operability.

In order to attain the above object, there is provided a tubular resin of the present invention comprising small animal repelling chemical for keeping the small animal off.

According to this feature, since this tubular resin can be provided on the inner wall of the inlet port of various pipes, entering of the small animal into the pipe can be prevented without disturbing an exhausting function or sucking function of the pipe.

Also, if this tubular resin is fitted in a drain pipe or an emergency pipe in canister structure installed in an automobile, entering of the small animal into the drain pipe or the emergency pipe can be prevented.

Also, canister structure installed in an automobile, of the present invention comprises a main body of a canister having an evaporated fuel adsorbent in its inside, a drain pipe connected to the main body of the canister for sucking an air from an outside, a supply pipe connected between the main body of the canister and an engine for supplying desorbed fuel from the absorbent together with a sucked air to an engine side. And the canister structure comprises a tubular resin provided onto an inner wall of an air inlet port portion of the drain pipe. The tubular resin contains small animal repelling chemical.

According to this feature of the above canister structure installed in the automobile, since the chemical containing resin in which the small animal repelling chemical is contained is fitted onto the inner wall of the air inlet port portion of the drain pipe, entering of the small animal can be prevented effectively at the inlet port of the drain pipe. Therefore, since the chemical containing resin is fitted on the inner wall of the air inlet port portion of the drain pipe, workers do not directly touch such chemical containing resin during the assembling operation of the drain pipe and its neighboring operations after the chemical containing resin has been fitted into the drain pipe, so that the presence of the chemical containing resin never makes worse the operability. Moreover, a cost can be reduced rather than the case where the overall drain pipe is formed by the chemical containing resin.

DESCRIPTION OF THE PREFERRED EMBODIMENT

An embodiment of the present invention will be explained with reference to the accompanying drawings hereinafter.

Figure 6:
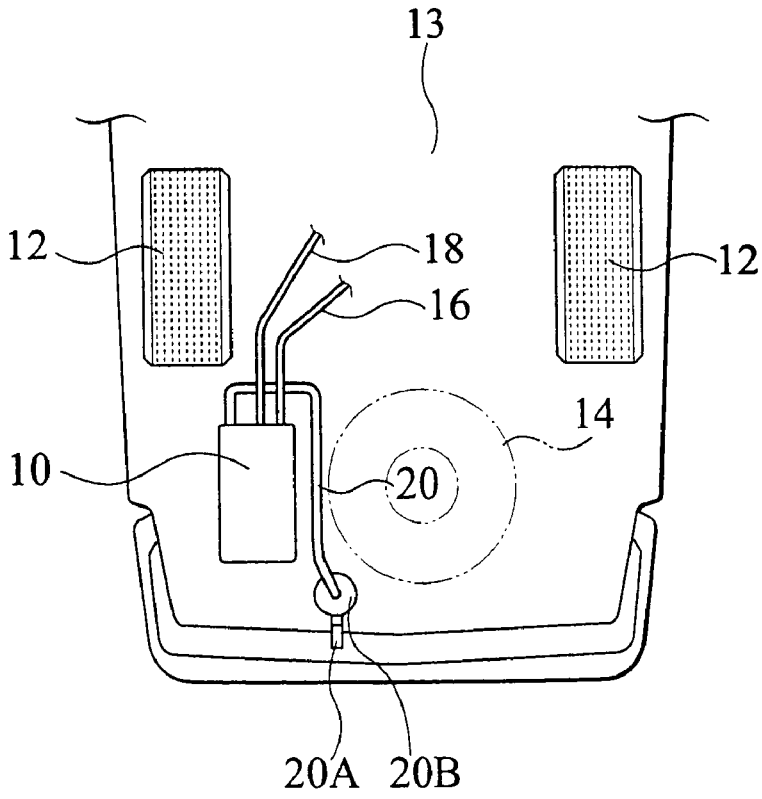
FIG. 6 is a bottom view showing a rear portion of a vehicle body according to the embodiment of the present invention.

FIG. 6 is a bottom view showing a rear portion of a vehicle body according to an embodiment of the present invention. A main body 10 of a canister according to the present embodiment is arranged in the neighborhood of the side portion of a spare tire pan 14 on a rear floor 13 in the rear of a rear wheel 12. A vapor pipe 16 connected to a fuel tank (not shown), a purge pipe 18 connected to an engine suction pipe, and a drain pipe 20 for introducing an air from the outside are connected to the main body 10 of the canister respectively.

A fuel adsorbent such as active carbon is filled into the main body 10 of the canister. Thus, an evaporated fuel generated in the fuel tank can be adsorbed by the fuel adsorbent in the main body 10 of the canister. During the operation of the engine, the fuel is desorbed from the fuel adsorbent because of the negative pressure in the engine suction pipe, then sucked into the engine together with an air being introduced via a drain pipe 20, and then burned in the engine. In this manner, the evaporated fuel being adsorbed into the main body 10 of the canister can be utilized effectively.

Figure 1:
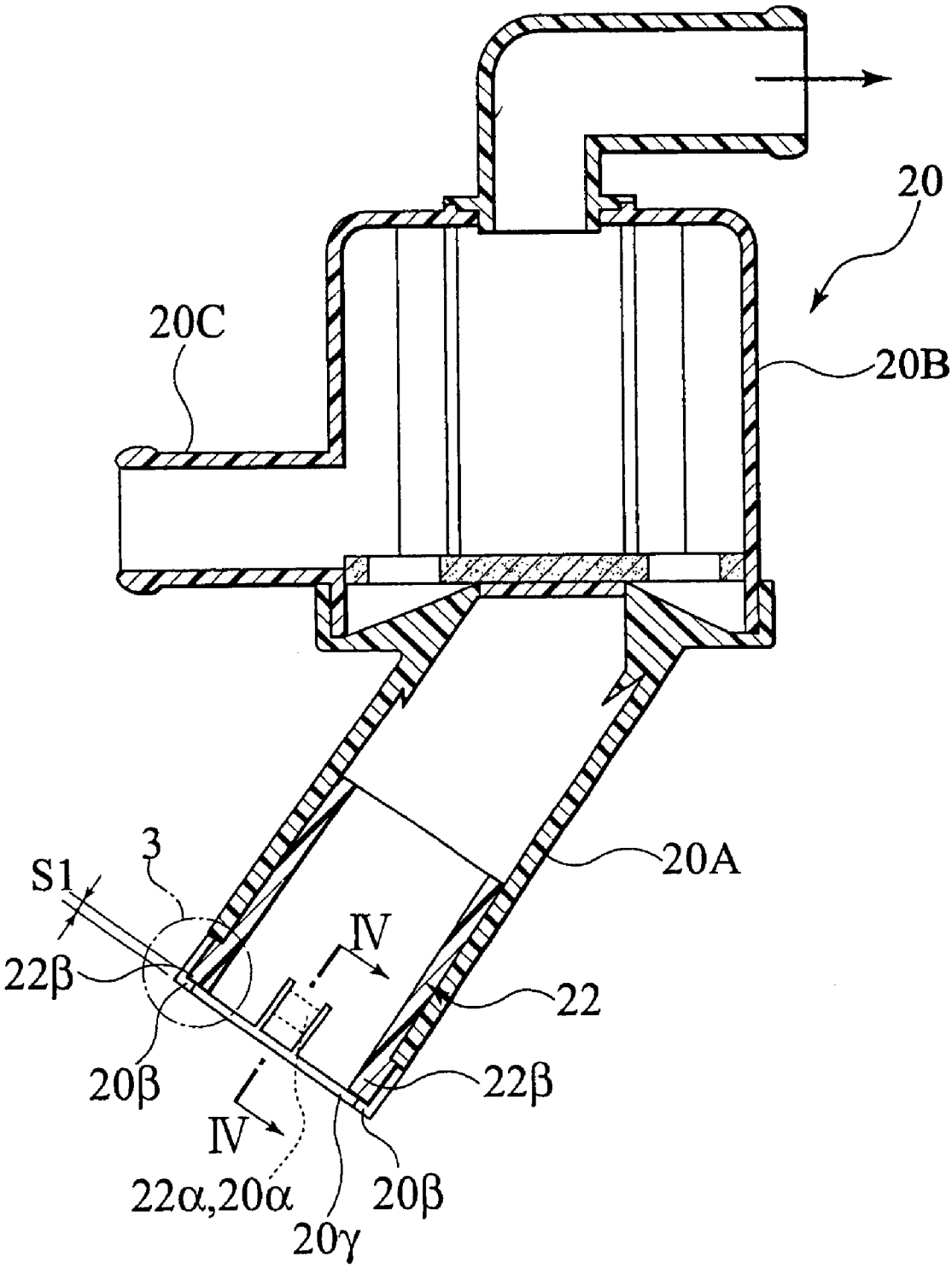
FIG. 1 is a sectional view showing a drain pipe portion of canister structure according to an embodiment of the present invention.

FIG. 1 is a sectional view showing a neighborhood of an air inlet port portion 20A of the drain pipe 20. In this embodiment, a separator 20B for absorbing and eliminating the moisture mixed in the air being sucked from the air inlet port portion 20A is provided directly on the air inlet port portion 20A. In this case, the separator 20B must not always be provided.

In order to prevent the entering of the small animal such as a spider belonging to chiracanthium, a chemical containing resin 22 into which small animal repelling chemical is impregnated is fitted .onto an inner wall of the air inlet port portion 20A of the drain pipe 20. The chemical containing resin 22 is formed like a tubular shape to come into almost tight contact with an entire periphery of an inner wall of the chemical containing resin 22.

The small animal repelling chemical is the chemical agent that has the activity for keeping off the small animal such as the insects containing the spider, etc. For example, the compound having the small animal repelling activity, the compound having the small animal killing activity, the compound having the taking-feed disturbing activity for the small animal, the compound having the growth control activity for the small animal, etc. are exemplified.

As the chemical having such small animal repelling property, there can be listed compound having the growth control activity for the small animal, etc. such as carbamate compound, pyrethlloyd compound, organic phosphorus compound, and their isomer, derivative, analogous substance, and others.

Also, as the resin constituting the chemical containing resin in which such small animal repelling chemical is contained, at least one of polyacetal resin and polyamide resin may be used. Further another compound which control to release the chemical may be added to the resin. As such compound, at least one compound selected from the group consisting of sulfonamide derivative, sulfonic ester derivative, carboxylic amide derivative, and carboxylic ester derivative, for example, is used.

In addition, in order to increase the controlled release much more and increase the mechanical properties, the fiber-like inorganic filler may be distributed. The above chemical containing resin 22 may be molded by the well known molding method such as the injection molding, etc.

Figure 2:
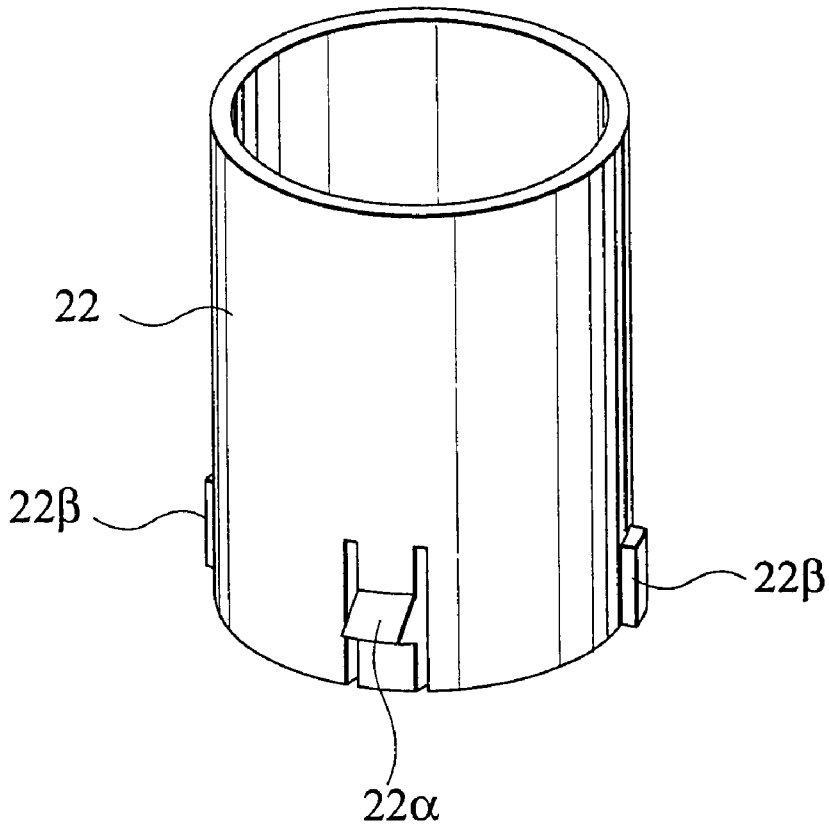
FIG. 2 is a perspective view showing a chemical containing resin according to the embodiment of the present invention.

FIG. 2 is a perspective view showing the chemical containing resin 22. Elastic clipping portions 22α each having a slit on its side surface are formed on the lower end of the chemical containing resin 22 to oppose to each other by 180 degree in the peripheral direction (only the clipping portion 22α on this side is visible). Keys 22β are formed respectively at the positions separated from the clipping portions 22α by 90 degree in the peripheral direction. The clipping portions 22α and the Keys 22β constitute engaging portions. Latching holes 20α into which the clipping portions 22 α are latched and key ways 20β into which the keys 22β are fitted are formed on a peripheral wall surface of the air inlet port portion 20A of the drain pipe 20. The latching holes 20α and the key ways 20β constitute engaged portions. Then, the chemical containing resin 22 can be positioned and fitted to the drain pipe 20 by engaging the clipping portions 22α into the latching holes 20α and fitting the keys 22β into the key ways 20β.

Figure 3:
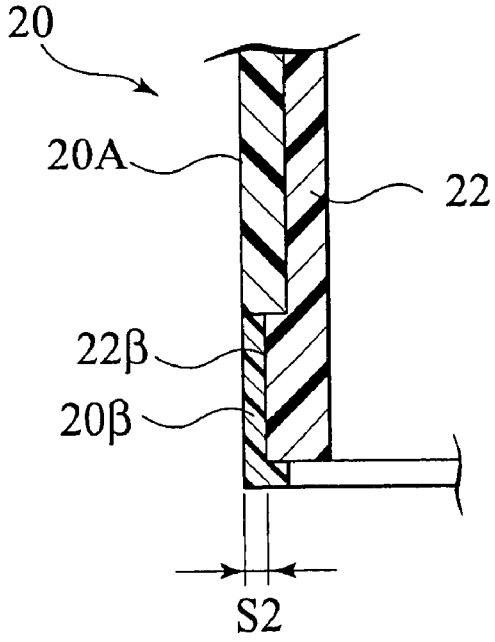
FIG. 3 is a sectional view showing a structure around an exit of the drain pipe (an area 3 surrounded by a broken line in FIG. 1) in the canister structure of the present invention.

As shown in FIG. 3, a projection height of the keys 22β in the outer diameter direction is set such that, when the keys 22β are fitted into the key ways 20β, they are not projected from the outer peripheral wall surface of the air inlet port portion 20A of the drain pipe 20 in the outer diameter direction, rather they are retreated from the outer peripheral wall surface of the air inlet port portion 20A by a dimension S2.

Figure 4:
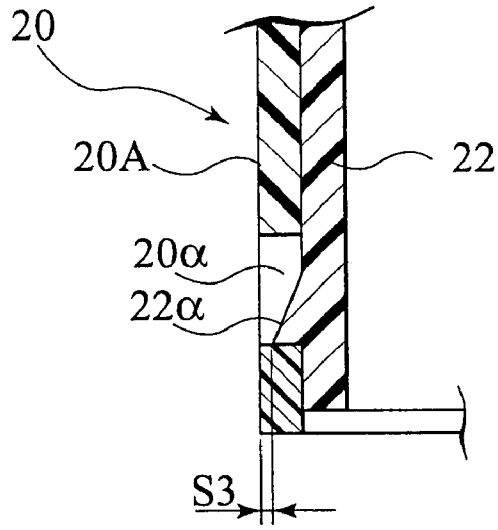
FIG. 4 is a sectional view showing a structure in which a chemical containing resin is fitted into the drain pipe (sectional shape taken along a line 4—4 in FIG. 1) in the canister structure of the present invention.

Similarly, as shown in FIG. 4, a projection height of the clipping portions 22α in the outer diameter direction is set such that, when the clipping portions 22α are engaged with the latching holes 20α, they are not projected from the outer peripheral wall surface of the air inlet port portion 20A of the drain pipe 20 in the outer diameter direction, rather they are retreated from the outer peripheral wall surface of the air inlet port portion 20A by a dimension S3.

In addition, as shown in FIG. 1, when the chemical containing resin 22 is fitted into the drain pipe 20, it is positioned at the position retreated from an inlet end 20*c* of the air inlet port portion 20A by a dimension S1.

A height of the tubular chemical containing resin 22 may be set to any height. In this case, it has been known that an average length of chiracanthium as the main small animal, that enters into the drain pipe to build its nest, is a little less than about 8 mm (for example, about ⅓ inch is set forth on page 583, The Spider Book (published by John Henry Comstock, Comstock Publishing Associates, a division of CORNELL UNIVERSITY PRESS)). Therefore, if the height of the tubular chemical containing resin 22 is set to more than the average length of the chiracanthium, the chiracanthium can be prevented from striding the chemical containing resin 22 to enter into the inside of the drain pipe 20.

In the drain pipe 20 constructed as above, since the chemical containing resin 22 which is impregnated with the small animal repelling chemical is fitted to the air inlet port portion 20A and also an evaporated gas of the small animal repelling chemical is emitted to the around, it is possible to prevent the entering of the small animal such as the spider belonging to the chiracanthium.

Since the chemical containing resin 22 has a tubular shape and thus there is no need to provide a mesh therein, increase of a pressure loss in the pipe can be suppressed and also the drain pipe 20 is not easily blocked by the mud or the snow.

The chemical containing resin 22 is fitted onto the inner wall of the air inlet port portion 20A of the drain pipe 20. Therefore, if the parts are delivered after the chemical containing resin 22 has been fitted into the drain pipe 20, workers do not directly touch the chemical containing resin 22 during the assembling operation of the drain pipe 20 and its neighboring operations, so that the presence of the chemical containing resin 22 does not make the working operability worse. Moreover, a cost can be reduced rather than the case where the overall drain pipe 20 is formed by the chemical containing resin.

As explained above, the chemical containing resin 22 can be fitted simply into the drain pipe 20 by engaging the clipping portions 22α into the latching holes 20α and fitting the keys 22β into the key ways 20β. Thus, a time required for the worker to handle the chemical containing resin 22 in the assembling operation can be shortened.

The clipping portions 22α are arranged at the position not to project from the outer peripheral wall surface of the air inlet port portion 20A of the drain pipe 20 in the outer diameter direction. Similarly, the keys 22β are arranged at the position not project from the outer peripheral wall surface of the air inlet port portion 20A of the drain pipe 20 in the outer diameter direction. As a result, workers cannot simply touch the chemical containing resin from the outside once the chemical containing resin 22 has been fitted into the drain pipe 20, therefore their working operability does not become worse.

Figure 5:
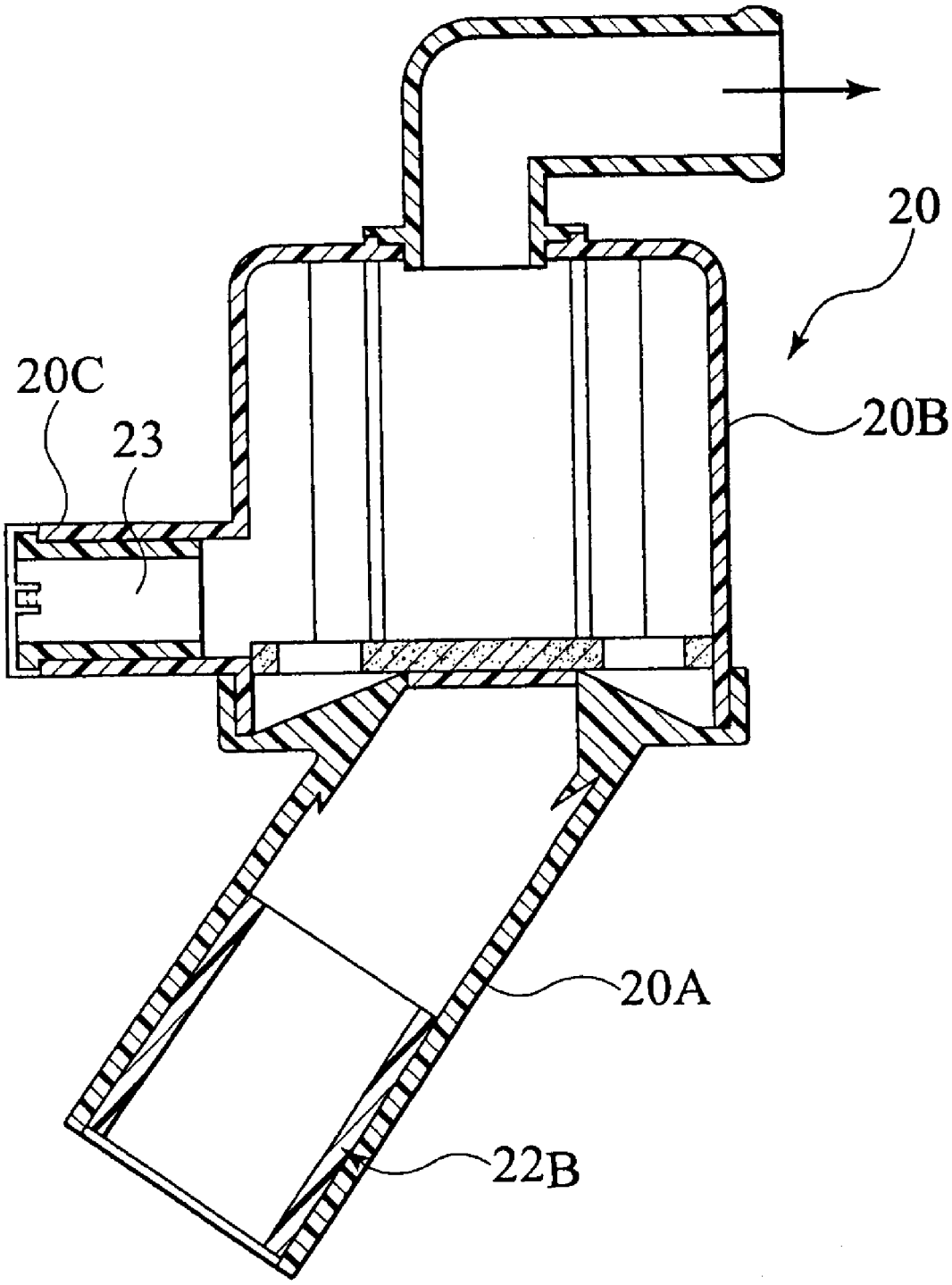
FIG. 5 is a sectional view showing a drain pipe portion in canister structure according to another embodiment of the present invention.

FIG. 5 is a sectional view showing a drain pipe portion in canister structure according to another embodiment of the present invention. An emergency pipe 20C which is used as the drain pipe at the time of emergency is connected to the separator 20B. As shown in FIG. 5, another tubular chemical containing resin 23 may be fitted into the inner wall of the air inlet port portion of the emergency pipe 20C. In this case, like the chemical containing resin 22 being fitted into the air inlet port portion 20A of the drain pipe 20, the chemical containing resin 23 may be fitted by engaging the engaging portions provided onto the chemical containing resin 23 with the engaged portions provided on to the inner wall of the separator 20B. Also, it is preferable that the chemical containing resin 23 should be positioned to be slightly retreated from the inlet end of the emergency pipe 20C. In addition, it is preferable that a length of the chemical containing resin 23 should be set to more than 8 mm.

Besides, the chemical containing resin 22 may be formed integrally with the drain pipe 20 by the insert molding, i.e., by inserting into the air inlet port portion 20A of the drain pipe 20, etc. Similarly, the chemical containing resin 23 may be formed integrally with the inlet port portion of the emergency pipe 20C. In this case, the above engaging portions can be omitted as the chemical containing resin 22B is shown in FIG. 5.

There is no necessity that sectional shapes of the tubular chemical containing resin 22, 23 should be formed as a complete annular shape. Thus, a C-shaped sectional shape which is formed by cutting away a part of the annular sectional shape may be employed. In addition, the tubular chemical containing resin 22, 23 may be formed by combining a plurality of members together to form the tubular shape.

The entire contents of Japanese Patent Application H11-245130 (filed Aug. 31, 1999) are incorporated herein by reference.

Although the invention has been described above by reference to certain embodiments of the invention, the invention is not limited to the embodiments described above. Modifications and variations of the embodiments described above will occur to those skilled in the art in light of the above teachings.

What is claimed is:

1. A tube made out of a resin fitted into a drain pipe or an emergency pipe of a canister structure for installation in an automobile, wherein the tube contains a small animal repelling chemical.

2. The tube made out of resin of claim 1, further comprising:

engaging portions to engage with the drain pipe or the emergency pipe.

3. The tube made out of resin of claim 1, wherein a length of the tubular resin is greater than or equal to 8 mm.

4. The tube made out of resin of claim 1, wherein the small animal repelling chemical contains a compound selected from the group consisting of a carbamate compound, a pyrethroid compound, an organic phosphorus compound, and derivatives thereof.

5. The tube made out of resin of claim 1, wherein the tubular resin body comprises a polyacetal resin or a polyamide resin.

6. The tube made out of resin of claim 1, further comprising: a compound selected from the group consisting of a sulfonamide derivative, a sulfonic ester derivative, a carboxylic amide derivative, and a carboxylic ester derivative.

7. The tube made out of resin of claim 1, wherein the small animal repelling chemical is an insect repelling chemical.

8. The tube made out of resin of claim 1, wherein the small animal repelling chemical is a spider repelling chemical.

9. A canister structure for installation in an automobile comprising:

a main body of the canister;

a drain pipe connected to the main body of the canister;

a tubular resin body provided on an inner wall of the drain pipe; and a small animal repelling chemical contained in the tubular resin body.

10. The canister structure of claim 9, wherein the drain pipe sucks in air from outside the main body, and wherein the tubular resin body is provided at a position recessed from a port end of an air inlet port portion of the drain pipe.

11. The canister structure of claim 9, wherein the drain pipe sucks in air from outside the main body, and wherein the tubular resin body comprises an engaging portion, and the drain pipe has an engaged portion on its inner wall surface of an air inlet port portion, whereby the tubular resin body is fitted into the drain pipe by engaging the engaging portion with the engaged portion, and the engaging portion does not project from an outer peripheral wall surface of an air inlet port portion of the drain pipe in an outer diameter direction.

12. The canister structure of claim 9, wherein the drain pipe sucks in air from outside the main body, and wherein the tubular resin body is formed integrally with the drain pipe on an inner wall of an air inlet port portion of the drain pipe.

13. The canister structure of claim 9, wherein a length of the tubular resin body is greater than or equal to 8 mm.

14. The canister structure of claim 9, further comprising:

an emergency pipe for operating as the drain pipe in a time of emergency; and another tubular resin body on an inner wall of an air inlet port portion of the emergency pipe; and a small animal repelling chemical contained in said another tubular resin body.

15. The canister structure of claim 9, wherein the small animal repelling chemical contains a compound selected from the group consisting of a carbamate compound, a pyrethroid compound, an organic phosphorus compound, and derivatives thereof.

16. The canister structure of claim 9, wherein the tubular resin body comprises a polyacetal resin or a polyamide resin.

17. The canister structure of claim 9, wherein the tubular resin body further comprises a compound selected from the group consisting of a sulfonamide derivative, a sulfonic ester derivative, a carboxylic amide derivative, and a carboxylic ester derivative.

18. The canister structure of claim 9, wherein the small animal repelling chemical is an insect repelling chemical.

19. The canister structure of claim 9, wherein the small animal repelling chemical is a spider repelling chemical.

20. The canister structure of claim 9, installed in an automobile.

21. An automobile comprising:

a canister structure with a drain pipe;

a tubular resin body provided on an inner wall of the drain pipe; and a small animal repelling chemical contained in the tubular resin body.

* * * * *